US012760504B2

(12) United States Patent
Schimicci

(10) Patent No.: US 12,760,504 B2
(45) Date of Patent: Oct. 13, 2026

(54) AUTOMATIC BATHTUB OVERFLOW DRAIN SWITCH

(71) Applicant: Michael Schimicci, Hazlet, NJ (US)

(72) Inventor: Michael Schimicci, Hazlet, NJ (US)

(73) Assignee: Tubsense LLC, Branchburg, NJ (US)

( * ) Notice: Subject to any disclaimer, the term of this patent is extended or adjusted under 35 U.S.C. 154(b) by 97 days.

(21) Appl. No.: 18/934,316

(22) Filed: Nov. 1, 2024

(65) Prior Publication Data

US 2026/0125884 A1 May 7, 2026

(51) Int. Cl.
*E03C 1/05* (2006.01)
*E03C 1/02* (2006.01)

(52) U.S. Cl.
CPC ..... *E03C 1/057* (2013.01); *E03C 1/055* (2013.01); *E03C 2001/026* (2013.01)

(58) Field of Classification Search
CPC ..... E03C 1/057; E03C 2001/026; E03C 1/055
USPC ..... 4/668
See application file for complete search history.

(56) References Cited

U.S. PATENT DOCUMENTS

| | | | | |
|---|---|---|---|---|
| 1,744,073 | A | 1/1930 | Gordon et al. | |
| 3,294,110 | A | 12/1966 | Stanislaus | |
| 3,770,002 | A | 11/1973 | Brown | |
| 3,987,502 | A | 10/1976 | Hartmann | |
| 4,042,984 | A | 8/1977 | Butler | |
| 4,258,444 | A | 3/1981 | Orszullok | |
| 6,186,162 | B1 * | 2/2001 | Purvis | F16K 31/043 251/251 |
| 6,732,388 | B2 | 5/2004 | McKenna | |
| 6,810,902 | B2 | 11/2004 | Bootka | |
| 6,952,843 | B2 | 10/2005 | Dunnett | |
| 7,007,319 | B2 | 3/2006 | Dunnett et al. | |
| 7,096,522 | B2 | 8/2006 | Hirtriter | |
| 7,350,245 | B2 | 4/2008 | Giagni | |
| 8,215,335 | B2 | 7/2012 | Barnham | |
| 9,695,579 | B2 | 7/2017 | Herbert et al. | |
| 10,982,419 | B2 * | 4/2021 | Baker | E03C 1/0408 |
| 2006/0253973 | A1 | 11/2006 | Brooks | |

* cited by examiner

*Primary Examiner* — Jennifer C Chiang
(74) *Attorney, Agent, or Firm* — Dunlap Bennett & Ludwig PLLC

(57) ABSTRACT

An automatic bathtub overflow shutoff system detects sustained water flow through a bathtub overflow drainpipe and automatically stops water supply to the bathtub in response. The system includes a tee pipe connector installed in-line along the overflow drainpipe below the overflow drain opening, a flow switch sensor positioned within a sensor port of the tee pipe connector to detect active water flow, a flow switch, a controller, and a first electronic shut off valve on a hot water supply line and a second electronic shut off valve on a cold water supply line. When overflow water flows through the tee pipe connector and is detected by the flow switch sensor, the flow switch signals the controller, which transmits a valve-close command to simultaneously close both supply valves, thereby terminating water entry into the bathtub.

12 Claims, 3 Drawing Sheets

AUTOMATIC BATHTUB OVERFLOW DRAIN SWITCH

BACKGROUND OF THE INVENTION

A bathtub overflow drain is a safety feature designed to prevent water from overflowing the tub and causing damage. The overflow drain is typically located near the top of the bathtub's wall, just below the rim. It connects to a pipe that leads to the main drain of the tub. When the water level rises and reaches the overflow drain, it flows into this pipe.

The overflow drain acts as a catchment area for excess water. If someone forgets to turn off the faucet or if the water level gets too high, the overflow is designed to divert the water ensuring it does not spill over the top edge. The drain usually has a cover that can be removed for cleaning, preventing clogs caused by debris or soap scum.

Conventional overflow drains, however, do not always work as intended, and the resulting flooding can often cause significant damage.

The present invention relates to an automatic flow switch that can turn off the water entering bathtub when it senses water at the bathtub overflow drain.

SUMMARY OF THE INVENTION

In one aspect of the present invention, there is disclosed a flow switch that connects to a bathtub overflow drain. The flow switch comprises a sensor for detecting water flow at bathtub overflow drain, and a controller for automatically turning off the water supply valves to the bathtub in response.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention relates to an automatic flow switch that can turn off the water entering bathtub when it senses water at the bathtub overflow drain. The flow switch is wired to an electric valve inside the overflow pipe. When it senses the flow of continuous water, the flow switch sends a signal to an electronic valve that shuts the water flow into the tub to avoid flooding.

Figure 1:
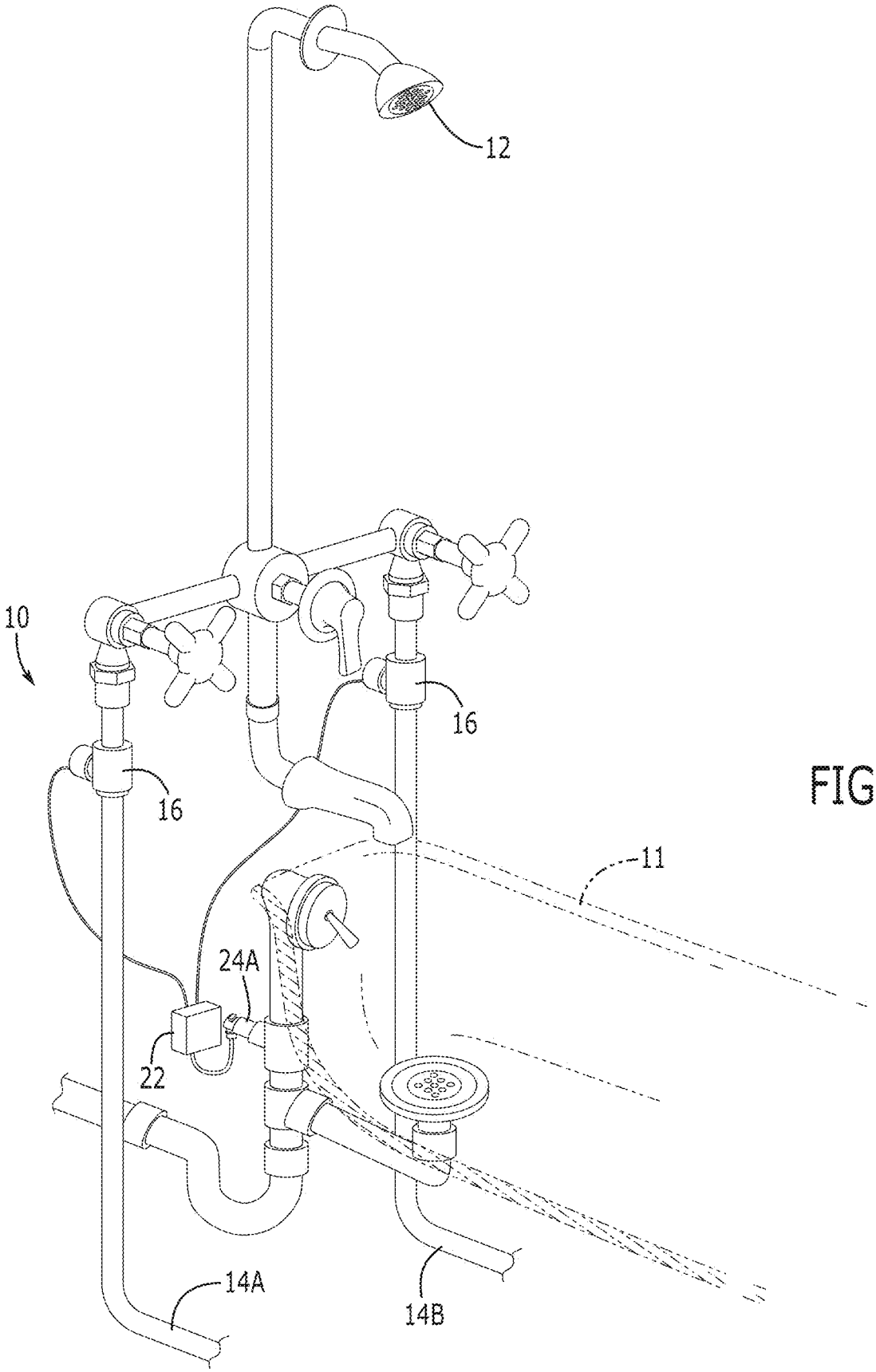
FIG. 1 is a schematic perspective view of an automatic bathtub overflow drain switch connected to a conventional bathtub in accordance with a preferred embodiment of the present invention.
Figure 2:
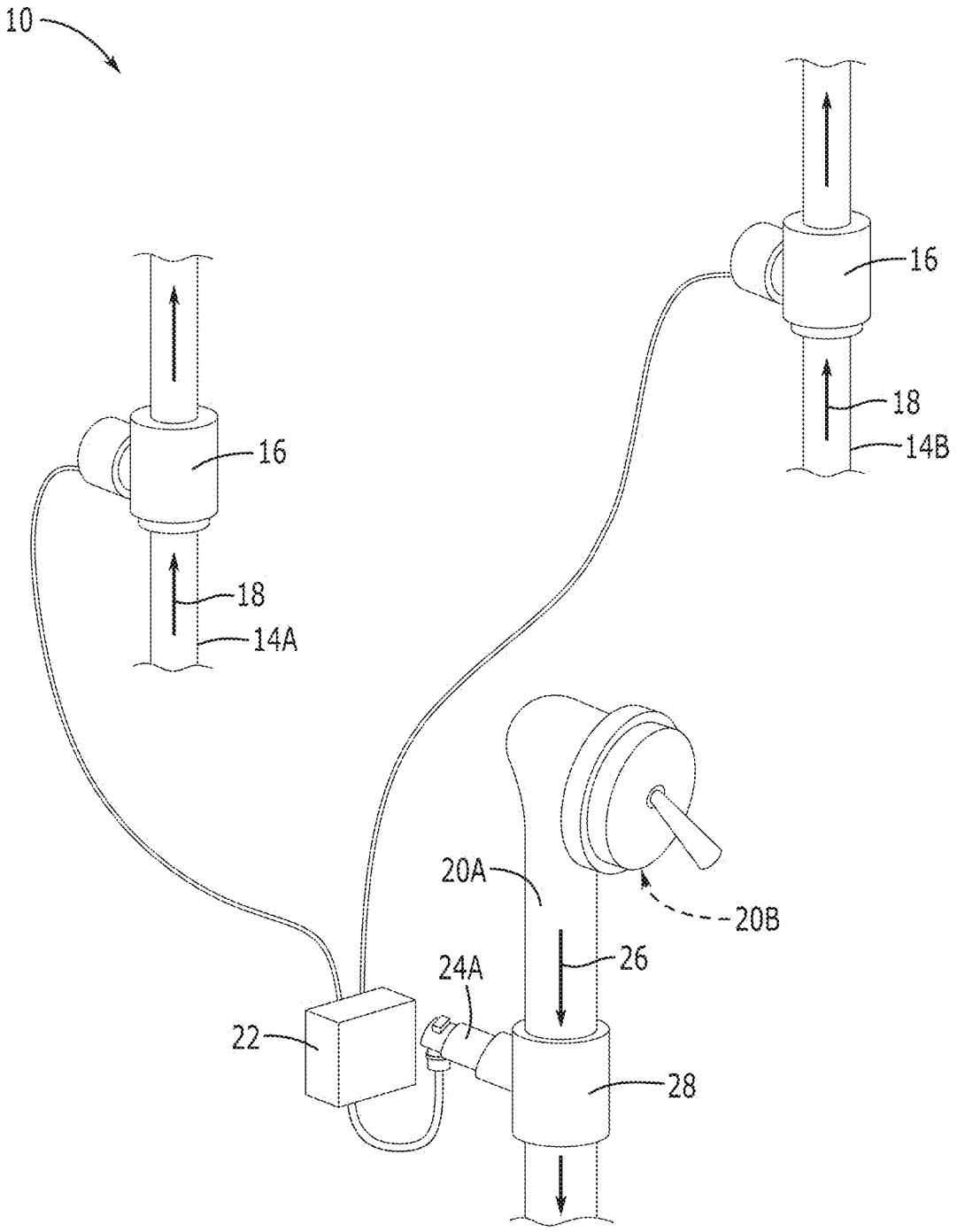
FIG. 2 is a schematic perspective view of the automatic bathtub overflow drain switch in accordance with a preferred embodiment of the present invention.
Figure 3:
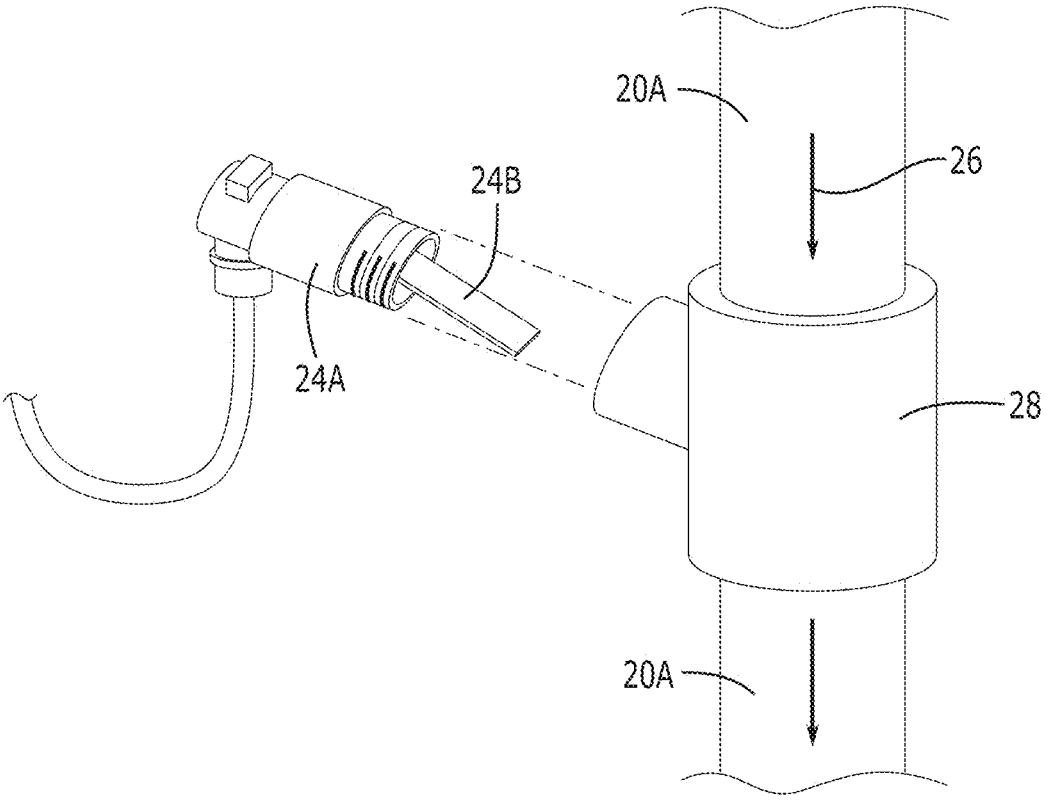
FIG. 3 is an exploded perspective view of the \ automatic bathtub overflow drain switch in accordance with a preferred embodiment of the present invention.

FIG. 1 depicts a perspective view of the automatic flow switch of the present invention installed on a conventional bathtub. Bathtub 11 is connected to hot water supply line 14A and cold water supply line 14B. The hot water flows through line 14A, passes through electronic shut off valve 16, and enters tub 11 via tub fill 30 or showerhead 12. Similarly, the cold water flows through line 14B, passes through electronic shut off valve 16, and enters tub 11 via tub fill or showerhead 12. The automatic flow switch 10 of the present invention comprises a controller 22 that is connected to electronic shutoff valves 16, as well as to flow switch 24A. As seen in FIGS. 2 and 3, flow switch 24A includes a flow switch sensor 24B that is positioned within tee pipe connector 28 that is positioned below overflow drain 20B along overflow drainpipe 20A. When the tub 11 is full and water is still being supplied in direction 18 through supply lines 14A and 14B and associated electronic valves 16, the water will flow through the overflow drain 20B in direction 26, through tee pipe connector 28, triggering flow switch sensor 24B.

When flow switch sensor 24B senses the water flow 26, flow switch 24 sends a signal to controller 22, which sends signals to electronic valves 16 to shut the water flow into tub 11 to prevent flooding. In a preferred embodiment, flow switch 24A is an adjustable sensitivity flow switch, wired to solenoid valves 16 via controller 22, which when triggered closes valves 16 via low voltage wiring.

It should be understood, of course, that the foregoing relates to exemplary embodiments of the invention and that modifications may be made without departing from the spirit and scope of the invention as set forth in the following claims.

What is claimed is:

1. A bathtub automatic flow switch system comprising:

a tee pipe connector configured to be installed in-line along a bathtub overflow drainpipe at a location below a bathtub overflow drain opening, the tee pipe connector having an inlet port in fluid communication with the overflow drain opening, an outlet port in fluid communication with a bathtub drain, and a sensor port;

a flow switch sensor positioned within the sensor port of the tee pipe connector, the flow switch sensor being oriented to detect active water flow passing through the tee pipe connector from the inlet port toward the outlet port;

a flow switch electrically connected to the flow switch sensor and configured to generate a shut-off signal upon receiving a detection signal from the flow switch sensor;

a controller electrically connected to the flow switch and configured to receive the shut-off signal;

a first electronic shut off valve positioned along a hot water supply line leading to the bathtub; and a second electronic shut off valve positioned along a cold water supply line leading to the bathtub;

wherein the controller is configured to transmit a valve-close command to both the first electronic shut off valve and the second electronic shut off valve upon receiving the shut-off signal from the flow switch, thereby stopping water flow into the bathtub.

2. The bathtub automatic flow switch system of claim 1, wherein the flow switch sensor is configured to generate a detection signal only after sensing continuous water flow within the tee pipe connector for a pre-determined period of time, the pre-determined period of time being set to a duration sufficient to distinguish sustained overflow conditions from transient water surges or splashing.

3. The bathtub automatic flow switch system of claim 1, wherein the flow switch is an adjustable sensitivity flow switch having a user-adjustable trigger threshold.

4. The bathtub automatic flow switch system of claim 1, wherein the first electronic shut off valve and the second electronic shut off valve are each solenoid valves.

5. The bathtub automatic flow switch system of claim 1, wherein the controller is electrically connected to the first electronic shut off valve and the second electronic shut off valve via low voltage wiring.

6. A bathtub overflow shutoff system comprising:

a bathtub having a bathtub wall, a hot water supply line, and a cold water supply line, the bathtub wall defining an overflow drain opening positioned at a predetermined water level below a rim of the bathtub;

an overflow drainpipe connected to the overflow drain opening and extending downward from the bathtub wall;

a tee pipe connector coupled in-line to the overflow drainpipe at a position below the overflow drain opening, the tee pipe connector comprising a flow path that receives water descending through the overflow drainpipe and a lateral sensor port extending transversely to the flow path;

a flow switch assembly comprising:

a flow switch sensor received within the lateral sensor port of the tee pipe connector and positioned to contact water flowing through the tee pipe connector, and a flow switch housing enclosing switching circuitry electrically connected to the flow switch sensor;

a controller communicatively coupled to the flow switch housing, the controller comprising logic configured to transmit a valve-close command in response to a signal received from the flow switch assembly;

a first solenoid valve installed in the hot water supply line upstream of the bathtub, the first solenoid valve transitioning from an open state to a closed state upon receiving the valve-close command; and a second solenoid valve installed in the cold water supply line upstream of the bathtub, the second solenoid valve transitioning from an open state to a closed state upon receiving the valve-close command;

wherein, when water in the bathtub rises to the overflow drain opening and flows downward through the overflow drainpipe and through the tee pipe connector, the flow switch sensor detects the water flow and causes the flow switch assembly to signal the controller to simultaneously close the first solenoid valve and the second solenoid valve, thereby terminating water supply to the bathtub.

7. The bathtub overflow shutoff system of claim 6, wherein the flow switch sensor is configured to generate a signal to the flow switch assembly only after detecting continuous water flow through the tee pipe connector for a pre-determined period of time, thereby preventing false activation caused by transient water surges.

8. The bathtub overflow shutoff system of claim 6, wherein the flow switch assembly is an adjustable sensitivity flow switch assembly having a user-selectable sensitivity setting that determines a minimum water flow rate required to trigger the flow switch sensor.

9. The bathtub overflow shutoff system of claim 6, wherein the controller is electrically connected to the first solenoid valve and the second solenoid valve via low voltage wiring operating at a voltage of 24 volts or less.

10. The bathtub overflow shutoff system of claim 6, wherein the tee pipe connector is configured for retrofit installation by disconnecting an existing overflow drainpipe at a location below the overflow drain opening, inserting the tee pipe connector in-line between the disconnected pipe sections, and securing the connections with threaded or slip-fit couplings.

11. The bathtub overflow shutoff system of claim 6, further comprising a tub fill spout and a showerhead each connected downstream of the first solenoid valve and the second solenoid valve, such that closure of the first and second solenoid valves simultaneously terminates water flow through both the tub fill spout and the showerhead.

12. The bathtub overflow shutoff system of claim 7, wherein the flow switch assembly is an adjustable sensitivity flow switch assembly and the pre-determined period of time is user-adjustable independently of the sensitivity setting, such that both the minimum flow rate required to trigger the sensor and the duration of detected flow required to generate the shut-off signal are independently configurable.

* * * * *